US009212547B2

(12) United States Patent
Miller et al.

(10) Patent No.: US 9,212,547 B2
(45) Date of Patent: Dec. 15, 2015

(54) MONITORING DEVICE FOR PLUG ASSEMBLY

(71) Applicants: James Miller, Willis, TX (US); Jason Mailand, The Woodlands, TX (US); Daniel Matthews, Houston, TX (US)

(72) Inventors: James Miller, Willis, TX (US); Jason Mailand, The Woodlands, TX (US); Daniel Matthews, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 396 days.

(21) Appl. No.: 13/755,697

(22) Filed: Jan. 31, 2013

(65) Prior Publication Data

US 2014/0208842 A1 Jul. 31, 2014

(51) Int. Cl.

| | |
|---|---|
| ***E21B 47/08*** | (2012.01) |
| ***E21B 47/10*** | (2012.01) |
| ***E21B 33/134*** | (2006.01) |

(52) U.S. Cl.

CPC ..... *E21B 47/10* (2013.01); *E21B 33/134* (2013.01)

(58) Field of Classification Search

CPC ..... E21B 49/10; E21B 49/08; E21B 47/10
USPC ..... 73/152.55
See application file for complete search history.

(56) References Cited

U.S. PATENT DOCUMENTS

2004/0020643 A1* 2/2004 Thomeer et al. ..... 166/250.01
2007/0272411 A1 11/2007 Lopez De Cardenas et al.
2011/0005754 A1 1/2011 Daniels et al.
2011/0240301 A1 10/2011 Robison et al.
2013/0256991 A1* 10/2013 Ramon et al. ..... 277/316

FOREIGN PATENT DOCUMENTS

EP 2251525 A1 11/2010
WO 2012045165 A1 4/2012

OTHER PUBLICATIONS

International Search Report and Written Opinion, date of mailing May 19, 2014, International Application No. PCT/US2014/014019, Korean Intellectual Property Office, International Search Report 6 pages; Written Opinion 10 pages.

Halliburton, [online]; [retrieved on Mar. 7, 2013]; retrieved from the Internet http://www.halliburton.com/public/tttcp/contents/Data_Sheets/web/H/H06151.pdf, "Fas Drill® TC Bridge and Frac Plugs," Halliburton Completion Tools, 2012 Halliburton, 3p.

* cited by examiner

*Primary Examiner* — Hezron E Williams
*Assistant Examiner* — Rodney T Frank
(74) *Attorney, Agent, or Firm* — Cantor Colburn LLP

(57) ABSTRACT

A monitoring tool, including an obstructor portion operatively arranged to impede fluid flow past the monitoring tool when the obstructor is engaged with a corresponding seat member. A disintegrable portion is included formed from a material operatively arranged to disintegrate upon exposure to a selected fluid. A gauge is coupled with the obstructor portion and the disintegrable portion. The gauge is operatively arranged to monitor one or more parameters and released from the obstructor portion when the disintegrable portion is disintegrated by the selected fluid. A method of monitoring one or more parameters is also included.

20 Claims, 1 Drawing Sheet

MONITORING DEVICE FOR PLUG ASSEMBLY

BACKGROUND

The downhole drilling and completions industry utilizes a variety of sensors and intelligent devices for monitoring various parameters during the performance of borehole operations. Many such operations include the pumping and control of fluids and are monitored to determine the effectiveness and/or efficiency of the operations. In hydraulic fracturing, for example, a fluid or slurry is pumped at high pressure to fracture a downhole formation, namely in order to facilitate the production of hydrocarbons therefrom. The measurement of parameters such as temperature, pressure, acoustics, etc. can be useful to operators not only to evaluate or aid in completing or producing from a given borehole, but also to enable operators to establish best practices for performing future operations based on past results. However, it is costly and time consuming to run the equipment necessary to monitor the performance of borehole operations. In view of the foregoing it can be appreciated that the industry would well receive advances and alternatives in monitoring tools and systems.

SUMMARY

A monitoring tool including an obstructor portion operatively arranged to impede fluid flow past the monitoring tool when the obstructor is engaged with a corresponding seat member; a disintegrable portion formed from a material operatively arranged to disintegrate upon exposure to a selected fluid; and a gauge coupled with the obstructor portion and the disintegrable portion, the gauge operatively arranged to monitor one or more parameters and released from the obstructor portion when the disintegrable portion is disintegrated by the selected fluid.

A method of monitoring one or more parameters, including engaging an obstructor portion of a monitoring tool at a seat member of a plug assembly; impeding fluid flow through the seat assembly with the obstructor portion; performing a fluid operation; monitoring at least one parameter of the fluid operation with a gauge of the monitoring tool coupled with the obstructor portion; and disintegrating a disintegrable portion of the monitoring tool in order to release the gauge from the monitoring tool upon exposure to a selected fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
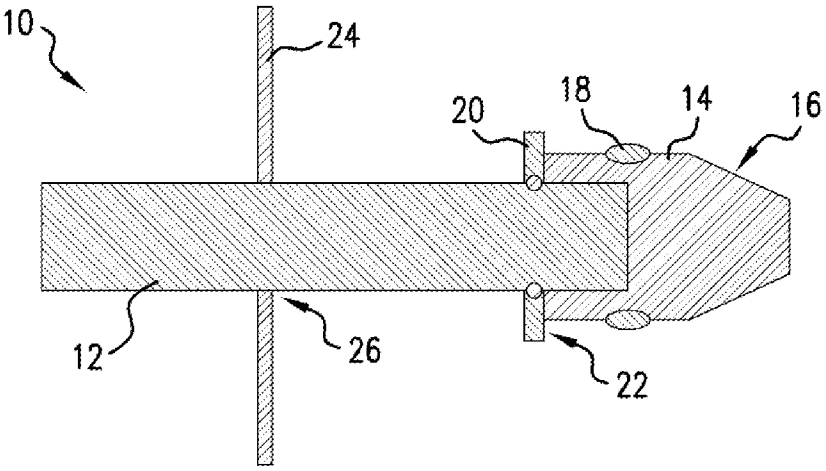
FIG. 1 is a cross-sectional view of a monitoring device.

Referring now to the drawings, FIG. 1 shows a monitoring tool 10. The tool 10 includes a gauge 12 that is arranged for measuring, sensing, or otherwise monitoring one or more parameters of an operation or condition desired to be monitored by the tool 10. In one embodiment, the tool 10 is utilized downhole and measures a parameter of a fluid flow used in a borehole operation. The parameter could include any measurable data, such as pressure, temperature, acoustics, etc. If used downhole, the operation could include any treatment or formation stimulation operation, notably hydraulic fracturing. In one embodiment, the gauge 12 includes a body that houses one or more sensors, along with storage media for storing values measured by the gauge 12. The parameter or parameters monitored by the tool 10 can be measured or sensed by the gauge 12 with respect to time and saved to the storage media, e.g., computer or electronic memory. This data can later be retrieved from the gauge 12, e.g., by interfacing the gauge 12 with a computer or other designated device after retrieval of the tool 10 from the downhole location as discussed in more detail below. The data obtained off the gauge 12 can be used for developing improved practices for more effectively or efficiently performing various operations, e.g., to assist in formulating standard practices for performing hydraulic fracturing under various borehole and formation conditions. A variety of monitoring devices are known in the art, and any suitably arranged for monitoring the desired parameter or parameters and withstanding the relevant conditions could be used as, for, or with the gauge 12.

The tool 10 also includes a nose portion 14, illustrated threaded to the gauge 12, although the nose portion 14 and the gauge 12 could be secured or coupled together in other ways. The nose portion 14 is arranged as an obstructor for preventing fluid communication past the tool 10 when the nose portion 14 of the tool 10 is engaged with and/or received by a corresponding seat member. For example, the nose portion 14 could act similarly to a drop ball, dart, or other object, with a tapered surface 16 sealingly engaging with a corresponding seat when the tool 10 lands at the seat. Alternatively, a seal element 18 disposed with the nose portion 14 can engage with a seal bore or other radially outwardly disposed feature into which the nose portion 14 at least partially protrudes. In order to position the seal element 18 with respect to a seal bore or other radially outwardly disposed member, the tool 10 can include a stop or no-go 20. The stop 20 could be a ring or a plurality of discrete elements protruding radially out from the nose portion 14, thereby enabling the tool 10 to be located when a profile or surface 22 of the stop 20 engages against a corresponding surface or profile of a tubular string or the like in which the tool 10 is used (e.g., as discussed below with respect to FIG. 2).

The tool 10 may also include one or more projections 24 extending radially therefrom. The projection 24 could have various functions for the tool 10. For example, the projection 24 could be arranged to increase the surface area of the tool 10 to better enable the tool 10 to be pumped in a flow of fluid to a downhole location or back to surface after monitoring is completed. The projection 24 could also be used as a wiper against an outer tubular in which the tool 10 travels to provide a wiper function for the internal passageway through the outer tubular. The projection 24 could also be arranged be arranged as a centralizer to assist in centralizing the tool 10 as it is pumped downhole to ensure that the nose portion 14 is properly aligned with a seat or other member with which the surface 16 and/or the seal element 18 engage to restrict fluid flow past the tool 10 when so engaged. In one embodiment, the projection 24 is formed by a plurality of arms that are hingedly secured to the gauge or other component of the tool 10, e.g., at a connection point 26, with a flexible or foldable membrane or material disposed between the arms to enable the projection 24 to fold up. When folded, fluid flow about the tool 10 is promoted, and when deployed the pumping of the tool 10 back to surface is facilitated after monitoring is complete.

Figure 2:
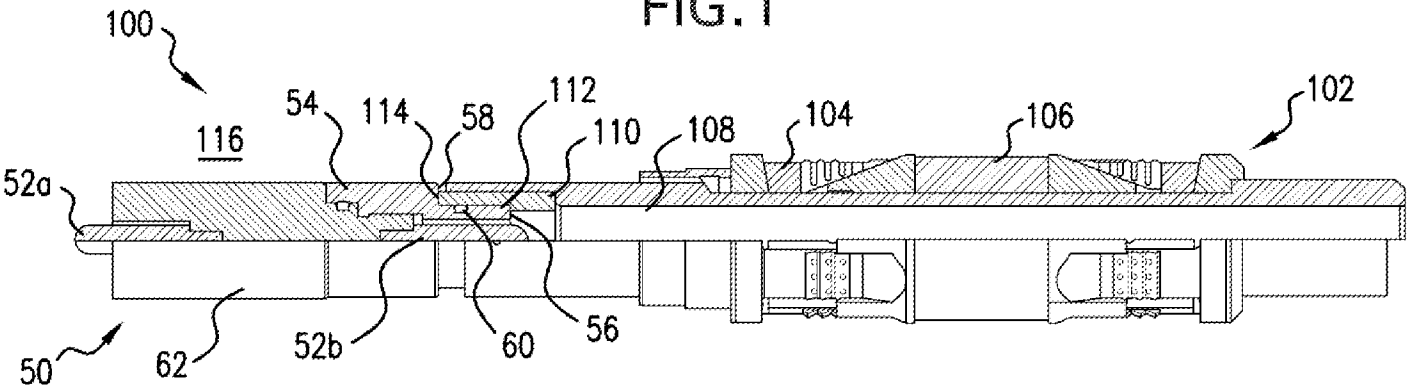
FIG. 2 is a quarter-sectional view of a system having a monitoring device engaged with a plug assembly.

A system 100 including a tool 50 engaged with a plug assembly 102 is shown in FIG. 2. The tool 50 shares several components with respect to the tool 10 and is generally arranged for the same purpose of monitoring one or more parameters, particularly during a downhole fluid treatment or stimulation operation. Instead of a single gauge 12, the tool 50 is illustrated having a pair of gauges 52*a* and 52*b*. However, the gauges 52*a* and 52*b* (collectively "the gauges 52") each generally resemble the gauge 12 in structure, purpose, and operation.

The tool 50 is arranged to sealingly engage with the plug assembly 102. As discussed above, the tool 10 is arranged to sealingly engage with a seat, profile, seal bore, etc. (generally, a "seat" or "seat member") in order to isolate opposite sides of the tool 10 from each other. Accordingly, it is to be appreciated that the tool 50 could be replaced by the tool 10, such that the tool 10 sealingly engages with the plug assembly 102 at that the surfaces 16 or 22 and/or with the seal element 18 as described above. Although illustrated having a different structure, the tool 50 includes a nose portion 54 similar in function to the nose portion 14, namely, arranged as an obstructor that sealingly engages with a corresponding seat member the plug assembly 102.

The plug assembly 102 could take the form of any plug assembly known in the art. In the illustrated embodiment, the plug assembly 102 includes a set of slips 104 and a sealing element 106 for anchoring the assembly 102 in an outer tubular member (e.g., a cased borehole, liner, or other component of a completion string) and sealing the exterior of the assembly 102 with respect to the outer tubular member. It is of course to be appreciated that the plug assembly 102 is provided as an example only and that other plug assemblies known or discovered in the art having other anchor or sealing elements could be used in lieu of those illustrated. That is, many plug assemblies, e.g., so called frac plug assemblies, are known in the art that generally resemble the plug assembly 102, and any such plug assembly could be utilized.

Frac plug assemblies are typically arranged to receive a ball, dart, or other object dropped from surface to occlude fluid flow through an internal passage through the plug assembly. Instead of receiving a ball, the plug assembly 102 is arranged to receive the tool 50 (or the tool 10) to block fluid flow into an interior passageway 108 of the plug assembly 102. To this end, the plug assembly 102 includes a seat member 110 arranged to receive and sealingly engage with the tool 50. The member 110 could be formed as an insert that is added to the plug assembly 102, as illustrated, or it could be formed integrally with the main body of the assembly 102. The seat member 110 includes one or more engagement or no-go surfaces or profiles, e.g., a surface 112 and a surface 114 that matingly engage with corresponding surfaces 56 and/or 58 of the nose portion 54. Similar to the surface 16 of the tool 10 discussed above, the surfaces 56 and/or 58 could be arranged to seal with the plug assembly 102 in order to occlude fluid flow from a volume 116 about the device 50 to the interior passage 108, as well as to locate the device 50 with respect to the assembly 102. Alternatively, the nose portion 54 or some other component of the device 50 could be arranged with a seal element 60, similar to the seal element 18, to facilitate the sealed engagement between the assembly 102 and the device 50.

Since the device 50 isolates the volume 116 from the interior passageway 108, the gauge 52*a* is arranged to monitor the desired parameter or parameters on one side of the sealed engagement, i.e., with respect to the volume 116, while the gauge 52*b* monitors on the other side, i.e., the interior passageway 108. It is of course to be appreciated that only one of the gauges 52 could be utilized or more gauges included, e.g., for redundancy in measuring the desired parameters at one or both sides of the device 50. It is similarly to be appreciated that the device 10 could be arranged with the gauge 12 monitoring on the opposite side of the device 10, as taught by the arrangement of the gauges 52 on the device 50. Additionally, the gauges 52*a* and 52*b* are illustrated as being secured to a body 62 that is then secured to the nose portion 54. It is to be appreciated that the body 62 could be integrally formed with the nose portion 54, if desired, but the illustrated embodiment facilitates manufacture of the device 50.

During some situations, solids, particles, or other materials or substances may build up around the tools 10 and 50, e.g., around the stop 20, nose portions 14 and 54, body 62, etc. The build-up may be caused from proppant or other solid particles in a fluid flow of a hydraulic fracturing or downhole formation treatment or stimulation operation, by sand or other particles contained in formation fluid, etc. Such build-up frustrates the ability to retrieve the tool 10 at surface, e.g., by creating frictional forces that prevents the tool 10 to be pumped back to surface in a flow of fluid. In order to overcome the aforementioned presence of solids or other impediments affecting to the ability of the gauge 12 to return to surface, the tool 10 may be arranged with a feature that facilitates retrieval of the gauges 12 and/or 52. By this it is meant that the monitoring devices 10 and/or 50, are operatively arranged with a feature to enable, allow, permit, or aid in the retrieval of at least a portion of the devices that includes the gauges. In one embodiment, the gauges 12 and/or 52 are made at least partially from buoyant materials, or otherwise house or contain buoyant materials, such as pockets of air or other low density gases.

In one embodiment, retrieval is facilitated by also detaching the gauges 12 and/or 52 from the nose portions 14 and/or 54, body 62, etc. Detachability of the gauges is achieved in one embodiment by disintegrating, dissolving, consuming, decomposing, corroding, degrading, or otherwise removing (generally "disintegrating") some portion or an entirety of the tools 10 and/or 50. In one embodiment, the nose portions 14 or 54, stop 20, body 62, or some other portions of the devices 10 and/or 50 are made from so-called controlled electrolytic metallic (CEM) materials in order to enable those portions of the devices 10 and/or 50 to disintegrate upon exposure to selected fluids (e.g., water, brine, acid, or combinations thereof), which may be the same fluids monitored by the monitoring assembly. By altering the composition of the CEM material, discussed in more detail below, the rate of disintegration can be set to take hours, days, weeks, months, etc. such that the gauges can be held in place and/or isolation maintained by the nose portions 14 and/or 54 or other obstructor portion for any desired amount of time before the selected disintegrable portions automatically disintegrate upon exposure to a selected fluid and release the plugs, enabling them to be return to surface. In one embodiment, the gauges 12 and/or 52 are secured or coupled to the nose portions 14 or 54, and/or body 62 via a component, e.g., a ring, fastener, etc., that is formed from a disintegrable material, with the nose portions 14 or 54 not disintegrating, e.g., in order to maintain isolation at the plug assembly 102.

It is to be noted that multiple systems according to the current invention could be run in succession in order to monitor the fracturing, treatment, stimulation, etc. of multiple zones along the length of the tubular string. In fact, it will be appreciated that the current invention monitoring devices can be utilized essentially in place of drop balls in known fluid operations. That is, one can perform essentially all of the same steps currently used in plug and perf or other fluid operations but instead of dropping a ball or plugging object to enable isolation at a corresponding seat or plug assembly, one would instead use a current invention monitoring device, e.g., the devices 10 or 50. Advantageously, this enables the use of the current invention devices with existing equipment and largely according to existing procedures, if so desired, although these monitoring devices could of course be used in other systems or according to other methods. As one example, openings in a first zone could be opened according to known procedures, e.g., via perforation guns or by actuating corresponding valve assemblies. Thereafter, a plug assembly could be run and set in an outer tubular string. The monitoring tool, e.g., the tool 10 or 50 is then dropped or launched and landed at the plug assembly to isolate the first zone for the treatment, fracturing, or other fluid operation. After the fluid operation is monitored and completed, the tool, e.g., the tool 10 or 50, can be retrieved, e.g., by pumping the tool back to surface. Retrieval of the tool may include leaving the nose portions 14 and/or 54, seal elements 18 and/or 60, stop 20, body 62, etc. in the borehole, which components or portions thereof may at least partially disintegrate. The gauges 12 and/or 52 can be reused in subsequent operations after the tools 10 and/or 50 have been retrieved from the borehole and the data retrieved from the gauges. Of course, generally according to known procedures, a subsequent plug assembly or other seat member can be located and set above the first zone and openings formed in a new zone, e.g., by running in perforation guns, before dropping or launching a new or subsequent monitoring tool. This process can be repeated as needed to fracture or treat any number of zones in a well, again, generally according to known techniques but with the tool 10 and/or 50 replacing standard drop balls. Similarly, the tools 10 and/or 50 could be used in lieu of drop balls to actuate sleeves to open ports in stimulation systems utilizing actuated valve assemblies.

An example of a CEM material that is suitable for this purpose is commercially available from Baker Hughes Inc. under the trade name IN-TALLIC®. A description of suitable materials can also be found in United States Patent Publication No. 2011/0135953 (Xu et al.), which Patent Publication is hereby incorporated by reference in its entirety. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications. Suitable core materials include electrochemically active metals having a standard oxidation potential greater than or equal to that of Zn, including as Mg, Al, Mn or Zn or alloys or combinations thereof. For example, tertiary Mg—Al—X alloys may include, by weight, up to about 85% Mg, up to about 15% Al and up to about 5% X, where X is another material. The core material may also include a rare earth element such as Sc, Y, La, Ce, Pr, Nd or Er, or a combination of rare earth elements. In other embodiments, the materials could include other metals having a standard oxidation potential less than that of Zn. Also, suitable non-metallic materials include ceramics, glasses (e.g., hollow glass microspheres), carbon, or a combination thereof. In one embodiment, the material has a substantially uniform average thickness between dispersed particles of about 50 nm to about 5000 nm. In one embodiment, the coating layers are formed from Al, Ni, W or $Al_2O_3$, or combinations thereof. In one embodiment, the coating is a multilayer coating, for example, comprising a first Al layer, an $Al_2O_3$ layer, and a second Al layer. In some embodiments, the coating may have a thickness of about 25 nm to about 2500 nm. These powder compacts provide a unique and advantageous combination of mechanical strength properties, such as compression and shear strength, low density and selectable and controllable corrosion properties, particularly rapid and controlled dissolution in various borehole fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A monitoring tool, comprising:

an obstructor portion operatively arranged to impede fluid flow past the monitoring tool when the obstructor is engaged with a corresponding seat member;

a disintegrable portion formed from a material operatively arranged to disintegrate upon exposure to a selected fluid; and a gauge coupled with the obstructor portion and the disintegrable portion, the gauge operatively arranged to monitor one or more parameters and released from the obstructor portion when the disintegrable portion is disintegrated by the selected fluid.

2. The monitoring tool of claim 1, wherein the obstructor portion defines the entirety of the disintegrable portion.

3. The monitoring tool of claim 1, wherein the disintegrable portion couples the gauge to the obstructor portion.

4. The monitoring tool of claim 1, wherein the parameter relates to a downhole fluid operation.

5. The monitoring tool of claim 4, wherein the downhole fluid operation includes hydraulic fracturing.

6. The monitoring tool of claim 1, wherein the obstructor portion includes a no-go profile or surface for at least one of locating the monitoring tool or impeding fluid flow past the monitoring tool.

7. The monitoring tool of claim 1, wherein the obstructor portion includes a seal element.

8. The monitoring tool of claim 1, further comprising a radial projection operatively arranged for centralizing the tool, increasing a surface area of the tool, providing a wiper function by the tool, or a combination including at least one of the foregoing.

9. The monitoring tool of claim 8, wherein the projection includes a hinged connection enabling the projection to fold and unfold.

10. A system including the monitoring tool of claim 1 and a plug assembly having a seat member operatively arranged to sealingly receive the obstructor portion of the monitoring tool.

11. The system of claim 10, wherein the plug assembly includes an anchor device, a seal element, or a combination including at least one of the foregoing.

12. The system of claim 10, wherein the plug assembly has a no-go profile engagable with a corresponding profile of the monitoring tool for enabling the monitoring tool to be located at the plug assembly.

13. The system of claim 10, further comprising a seal element disposed between the obstructor portion of the monitoring tool and the seat member of the plug assembly.

14. A method of monitoring one or more parameters, comprising:

engaging an obstructor portion of a monitoring tool at a seat member of a plug assembly;

impeding fluid flow through the seat assembly with the obstructor portion;

performing a fluid operation;

monitoring at least one parameter of the fluid operation with a gauge of the monitoring tool coupled with the obstructor portion; and disintegrating a disintegrable portion of the monitoring tool in order to release the gauge from the monitoring tool upon exposure to a selected fluid.

15. The method of claim 14, further comprising retrieving the gauge.

16. The method of claim 15, wherein retrieving the gauge includes pumping the gauge in a fluid flow.

17. The method of claim 14, further comprising storing data relating to the fluid operation with the gauge and retrieving the data from the gauge.

18. The method of claim 14, wherein the fluid operation includes hydraulic fracturing.

19. The method of claim 14, further comprising repeating the method with a subsequent monitoring tool and a subsequent plug assembly for at least one other location.

20. The method of claim 14, wherein the selected fluid is involved in the fluid operation.

* * * * *